US007509992B2

(12) United States Patent
Fragoso

(10) Patent No.: US 7,509,992 B2
(45) Date of Patent: Mar. 31, 2009

(54) KABUKI STAGE SETTING RELEASE DEVICE

(76) Inventor: Jesus "Chuy" Fragoso, 48 Teal La., Sagle, ID (US) 83860

( * ) Notice: Subject to any disclaimer, the term of this patent is extended or adjusted under 35 U.S.C. 154(b) by 239 days.

(21) Appl. No.: 11/732,251

(22) Filed: Apr. 3, 2007

(65) Prior Publication Data

US 2007/0234833 A1 Oct. 11, 2007

(51) Int. Cl.
*A63J 1/02* (2006.01)

(52) U.S. Cl. ..... 160/331; 472/77; 472/79

(58) Field of Classification Search ..... 160/331; 472/77–79

See application file for complete search history.

(56) References Cited

U.S. PATENT DOCUMENTS 1,008,516 A 11/1911 Autenrieth et al.
3,757,471 A 9/1973 Dougherty
4,074,388 A 2/1978 McCabe
4,130,156 A 12/1978 Wardlaw
5,850,865 A 12/1998 Hsieh
6,219,959 B1 4/2001 Hsieh
6,598,652 B1 7/2003 Montesinos

FOREIGN PATENT DOCUMENTS

DE 29906503 U1 * 8/1999

* cited by examiner

*Primary Examiner*—Ramon M Barrera
(74) *Attorney, Agent, or Firm*—Bergman & Jeckle, PLLC

(57) ABSTRACT

A Kabuki device to positionally maintain and release a stage setting responsive to electric current from a power source. A box-like body, defining a medial chamber with a slot communicating therewith, carries a solenoid in the chamber. A movable solenoid arm communicates with a spring biased lever arm that pivots on an offset axle to provide mechanical advantage to one end of the solenoid arm. One metal ring interconnected to the stage setting is inserted through the slot and is positionally maintained by a ring support pin carried by the pivoting lever arm. A finger hole defined in one end of the body allows manual manipulation of the lever arm for resetting. Jumper cables having plural electrical leads allow a plurality of devices to be interconnected in series in multiple predetermined groupings.

9 Claims, 6 Drawing Sheets

KABUKI STAGE SETTING RELEASE DEVICE

II. BACKGROUND OF INVENTION

IIA. Related Applications

There are no applications related hereto heretofore filed in this or in any foreign country.

IIB. Field of Invention

This invention relates to partition control devices, and more particularly to a device for positionally maintaining a stage setting and releasing the stage setting in response to a remotely generated electric signal.

IIC. Background and Description of Prior Art

Stage setting release devices, commonly known as Kabuki devices, are used in the entertainment and media industries to positionally maintain depending stage settings, such as curtains, back drops, banners and scenery changes and to release the stage settings on cue and to open performances, change backgrounds and reveal new products. Although vertical drops are most common, stage settings may also be tensioned between biasing means at one edge portion and Kabuki devices at the opposing edge portion, so that upon release by the Kabuki devices the stage setting moves toward the biasing means horizontally across a stage.

Known Kabuki devices provide a push/pull solenoid and an associated elongately movable pin that are carried within the chamber of a peripherally defined body. The body defines a slot in the surface facing the direction of release of the stage setting in which a sector of a metal ring interconnected to an edge portion of the stage setting is carried. The elongately movable pin is interconnected to the solenoid at a first end portion. The second end and medial portions of the elongately movable pin extend transversely across the slot and through the medial void portion of the metal ring carried therein, so that the metal ring is supported directly upon the elongately movable pin. Actuation of the solenoid moves the solenoid arm which responsively moves the elongately movable pin toward the first end to a position whereat the pin no longer extends through the metal ring to release the metal ring from the slot to responsively release the stage setting.

Known Kabuki devices have various drawbacks and are prone to intermittent failures. Carrying the metal ring directly upon the elongately movable pin is a frequent cause of such failures because the weight of the stage setting, and the forces applied thereby, are transverse to movement of the elongately movable pin. These transverse forces increase friction that tend to cause the pin to bind, occasionally preventing pin movement and release of the metal ring and the stage setting. The binding may be exacerbated by use, as well as by misalignment of the solenoid arm and the pin. Increased friction also requires more electrical power for the solenoid to move the pin. Precision manufacturing is therefore essential, and rough handling of known Kabuki devices, during transport or otherwise, may decrease efficiency and reliability by altering the axial alignment of the solenoid arm and elongately movable pin.

Known Kabuki devices are also difficult to load because the elongately movable pin is not easily accessible. Generally a screwdriver or other thin elongate item must be used to move the pin rearwardly so that the metal ring may be placed in the slot and about the pin. Additionally there is no ready means to test whether the electrical circuit, created when plural Kabuki devices are interconnected in series, is complete, other than activating the device which releases the metal ring and the stage setting. Such testing is impractical once the devices and stage settings have been installed and raised for operation.

The present invention seeks to overcome these drawbacks to known Kabuki devices by providing an improved Kabuki device that is more reliable and durable, is easy to load and has an electrical circuit that may be tested without releasing the stage settings.

My improved Kabuki device releasably carries one metal ring of a stage setting, in a triangular ring chamber that communicates with a slot defined in the body on a ring support pin carried at one end portion of a spring biased pivoting lever arm. The pivoting lever arm provides mechanical advantage to the solenoid arm to ensure reliably consistent pin motion, eliminates friction caused by the transverse forces of the stage setting on the pin and reduces the electrical current necessary for the solenoid to release the stage setting.

A finger hole defined in an end cap of the body, adjacent the lever arm, allows manipulation of the lever arm to simplify loading my Kabuki release device. Interconnecting interlocking wiring connectors allow plural Kabuki devices to be interconnected with one another in series. A power indicator test light is releasably attachable to each series connected group of Kabuki devices to test the connectivity of each series circuit without activating the solenoids.

My invention does not reside in any one of these identified features individually, but rather in the synergistic combination of all of its structures, which give rise to the functions necessarily flowing therefrom as hereinafter specified and claimed.

III. SUMMARY

My Kabuki stage setting release device generally provides a body defining a medial chamber with a slot communicating through the body of the chamber, and carries a connector to releasably fasten the body to a support structure. An electrical series current provides a solenoid carried within the medial chamber of the body operatively communicates through a switch to an external power source that supplies electric power to cause the solenoid to move a solenoid arm. A spring biased lever arm carried in the medial chamber, having a first end portion connected to the solenoid arm and a second end portion carrying a ring support pin, pivots on an axle responsive to motion of the solenoid arm to release a metal ring supported in the body slot upon the ring support pin. A finger hole defined in the body allows manual manipulation of the lever arm to load the metal ring onto the ring support pin. Cable jumpers, having a releasable electrical plug connector at each opposing end portion, operatively interconnect at least one group of Kabuki devices in a series circuit. A power indicator test light may be releasably engaged with each group of Kabuki release devices in a series circuit to test the circuit without activating the solenoids.

In providing such a device it is:

A principal object to provide a Kabuki device that uses a solenoid to power a pivoting lever arm to create mechanical advantage to release a metal ring supporting a positionally maintained stage setting.

A further object is to provide such a device that lessens friction between the metal ring interconnected to the stage setting and a ring support pin supporting the metal ring to reduce friction and the likelihood of device failure.

A further object is to provide such a device that requires less electrical power for operation to allow more devices to be interconnected in a single series circuit.

A further object is to provide such a device that uses multiple contact plug-type electrical connectors so that plural groups of a set of devices may be operated independently with a single wiring harness.

A further object is to provide such a device that may be loaded without the use of ancillary tools.

A further object is to provide such a device that allows a circuit formed by plural series interconnected devices to be tested with a second power indicator test light circuit without actuating the solenoids.

A still further object is to provide such a device that has recessed electrical connectors on the body to protect the connectors from damage during transport installation and use.

A still further object is to provide such a device that is of new and novel design, of rugged and durable nature, of simple and economic manufacture and otherwise is well suited to the uses and purposes for which it is intended.

Other and further objects of my Invention will appear from the following specification and accompanying drawings which form a part hereof. In carrying out the objects of my invention, however, it is to be understood that its structures and features are susceptible of change in design and arrangement with only one preferred and practical embodiment of the best known mode being illustrated in the accompanying drawings and specified as is required.

IV. BRIEF DESCRIPTIONS OF DRAWINGS

In the accompanying drawings which form a part hereof and wherein like numbers of reference refers to similar parts throughout:

V. DESCRIPTION OF PREFERRED EMBODIMENT

As used herein, the term "forward", its derivatives, and grammatical equivalents refer to that portion of the Kabuki device closest to first end 11*b*. The term "rearward", its derivatives, and grammatical equivalents refer to that portion of the device closest to second end 11*c*. The term "top", its derivatives and grammatical equivalents refer to that portion of the device carrying hinged scaffold clamp 12. The term "bottom", its derivatives and grammatical equivalents refer to that portion of the device defining slot 24.

The term "stage setting" includes curtains, partitions, screens, backdrops, banners and other similar sheet-like flexible structures used in stage performances and product introduction displays. Stage settings commonly are moved from a pre-established position by reason of the force of gravity, or in other directions by biasing means.

Figure 1:
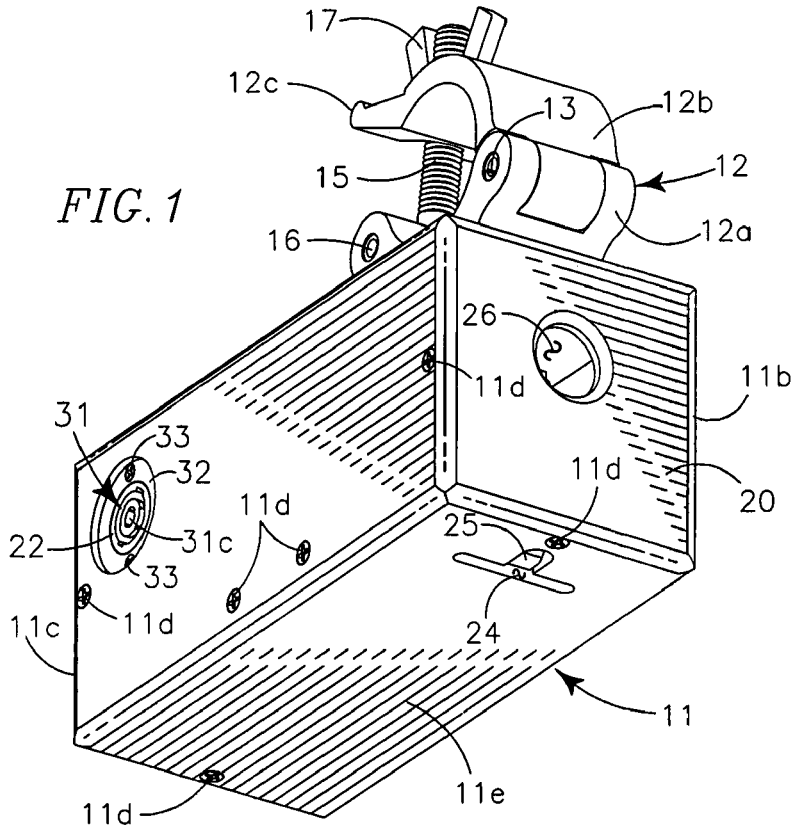
FIG. 1 is an isometric bottom, front and right side view of my Kabuki device.
Figure 2:
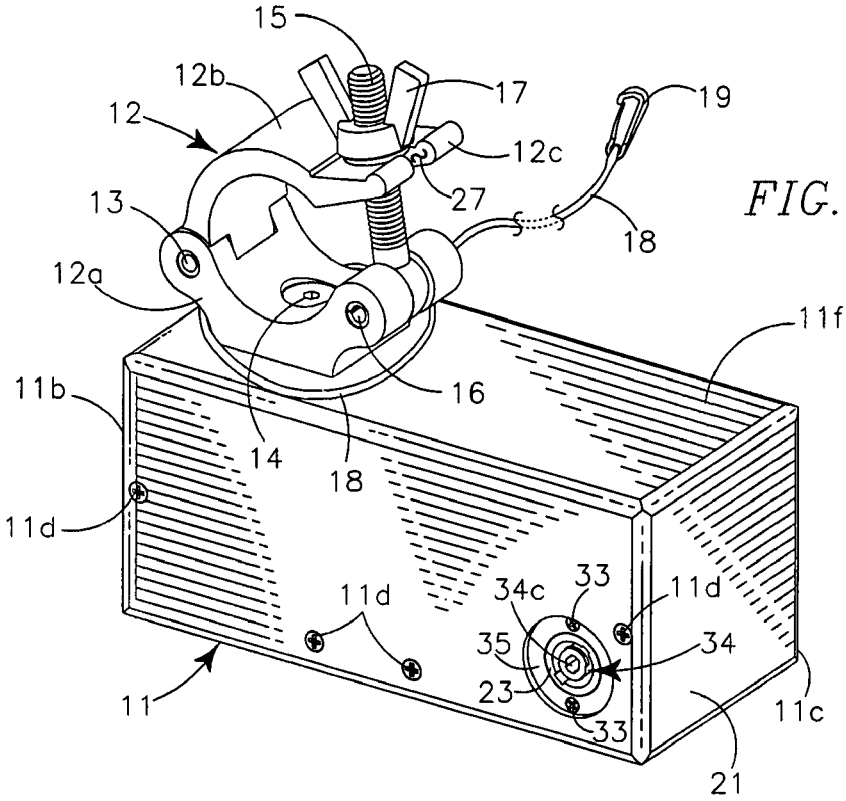
FIG. 2 is an isometric top, rear and left side view of the device of FIG. 1.
Figure 4:
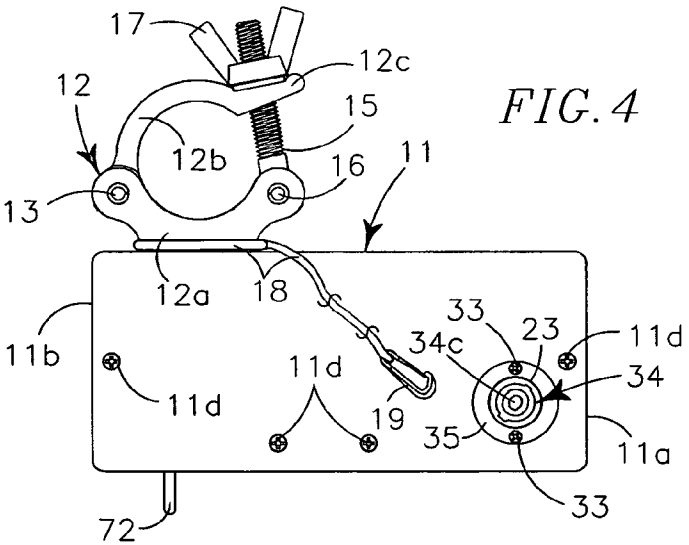
FIG. 4 is an orthographic left side view of the device of FIG. 1.
Figure 6:
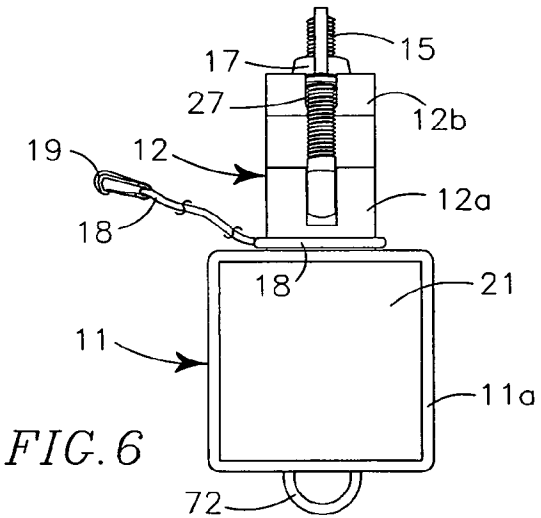
FIG. 6 is an orthographic rear view of the device of FIG. 1.
Figure 3:
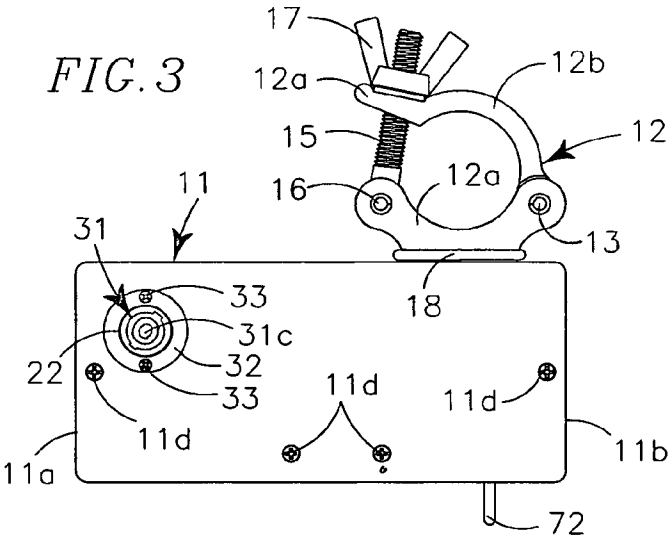
FIG. 3 is an orthographic right side view of the device of FIG. 1.
Figure 5:
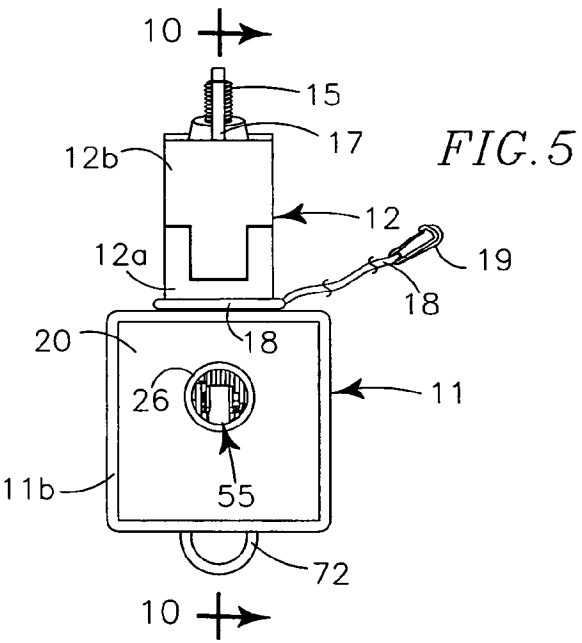
FIG. 5 is an orthographic front view of the device of FIG. 1.
Figure 7:
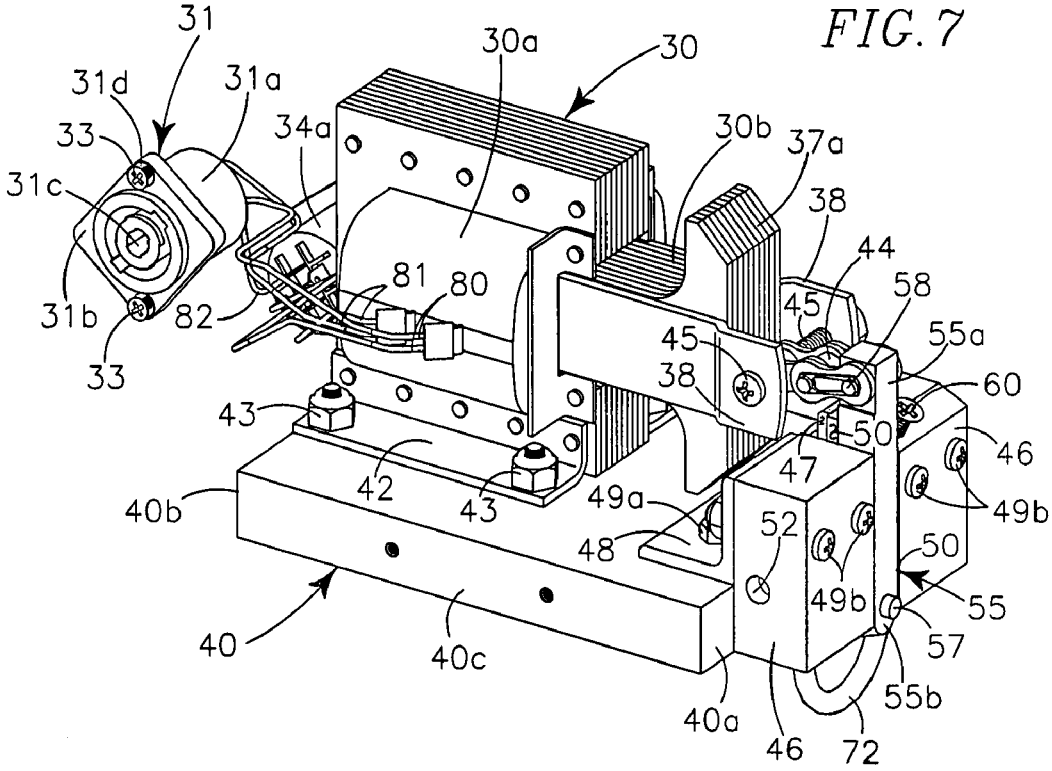
FIG. 7 is an isometric top, front and right side view of the solenoid, base and lever arm of my Kabuki device with the box beam body removed.

As shown in FIGS. 1 and 2, my Kabuki device has a peripherally defined rigid box body 11 defining medial chamber 11*a* (FIG. 10) and having first rearward end 11*b* and second forward end 11*c*. A transverse slot 24 communicating through the box body 11 to chamber 11*a* is defined in the bottom 11*e* of the body 11, spacedly adjacent first rear end 11*b*, through which a sector of metal ring 72 (FIG. 10 not shown) that is attached to a stage setting (not shown) is inserted. Releasable fasteners 11*d* secure first end cover 20 and second end cover 21 to body 11 and also positionally secure base 40 carrying solenoid 30 (FIGS. 7-8) in medial chamber 11*a*. Finger hole 26 is defined in the first rearward end cover 20 to communicate with chamber 11*a* to allow an operator to insert a finger therethrough to manually manipulate pivoting lever arm 55 (FIG. 5) to load the Kabuki device with metal ring 72.

A hinged scaffold clamp 12 is releasably fastened to the top portion of the body 11, spacedly adjacent the first end 11*b*, by nut-bolt type fastener 14. The hinged scaffold clamp 12 has base portion 12*a* with a lower planar surface to fit upon top 11*f* of body 11 and an upper arcuate surface to fit upon a cylindrical support. The base portion 12*a* carries arcuate pivoting portion 12*b* by means of hinge axel pin 13 extending between interconnecting hinge portions of the scaffold clamp portions 12*a* and 12*b* formed in their forward end portions. The pivoting portion 12*b* extends rearwardly and downwardly only to an arcuate distance spacedly adjacent to base portion 12*a* to define a gap therebetween and terminates with a radically outwardly extending fastening ear 12*c*. The fastening ear 12*c* defines the medial notch 27 in its outer end portion to fastenably receive threaded clamp bolt 15 pivotally carried by the forward end portion of base portion 12*a* of scaffold clamp 12. Wing nut 17 carried by the clamp bolt 15 releasably closes and fastens the scaffold clamp 12 on a support structure (not shown) by securing together the opposing portions 12*a*, 12*b* of the scaffold clamp 12. Safety wire 18, carried by base portion 12*a* and formable into a loop thereabout, carries releasable connector 19 at the non-secured end portion to fasten about a support structure to provide safety redundancy in securing the body 11 to the support structure (not shown).

Holes 22, 23 are defined in each side portion of the body 11 spacedly adjacent second rearward end 11*c* to releasably carry first wiring plug connector 31 and second wiring plug connector 34, respectively, therein. Annular recesses 32, 35 are formed in the body 11 about each hole 22, 23 so that the first and second wiring plug connectors 31, 34 are recessed into the body 11 for protection from damage.

Base 40 (FIGS. 7, 8) is carried in the medial chamber 11*a* of body 11 and secured therein with plural releasable fasteners 11*d* (FIGS. 1, 2) extending through holes (not shown) defined in the body 11. Base 40 is formed of nonconductive, nonmagnetic material such as wood or plastic, to a generally rectilinear configuration having first forward end 40*a*, second rearward end 40*b*, first elongate lateral edge 40*c* and second elongate lateral edge 40*d*. An "L" shaped lever block bracket 48 that defines medial slot 47 is fastened to base 40, adjacent the first forward end 40*a*, with plural releasable fasteners 49*a*. Similar opposed lever blocks 46 are fastened to the lever block bracket 48 at each opposing side of the notch 47 with releasable fasteners 49*b* so that lever slot 50 is defined between the two spacedly adjacent lever blocks 46. Each lever block 46 defines an aligned lever arm axle hole 52 extending transversely therethrough and a triangular recess 53 (FIG. 9) in a bottom corner portion adjacent the lever slot 50 and first forward end portion 40*a* of the base 40. The triangular recesses 53 (FIG. 9) defined in each lever block 46 and the lever slot 50 therebetween define generally trapezoidal ring chamber 51 with a shorter top (not shown) oriented toward the top of the body 11 and longer base that communicates with the slot 24 defined in the bottom of the body 11. The trapezoidal configuration of the ring chamber 51 positionally centers a sector of metal ring 72 that is inserted therein during loading of the Kabuki device.

Figure 9:
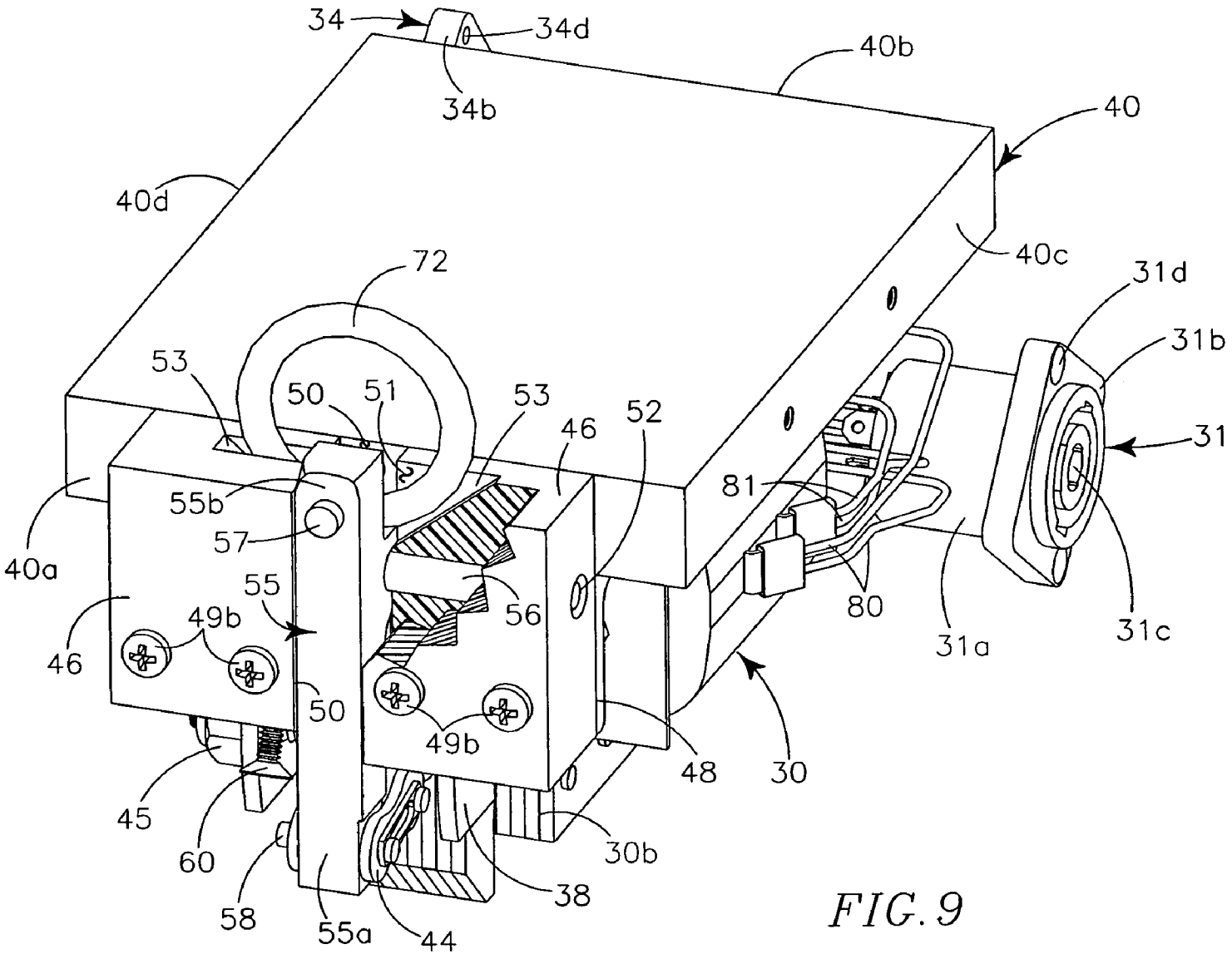
FIG. 9 is an enlarged isometric bottom, front and right side view of the mechanism of FIG. 7 partially cutaway to show the lever arm axle detail.
Figure 10:
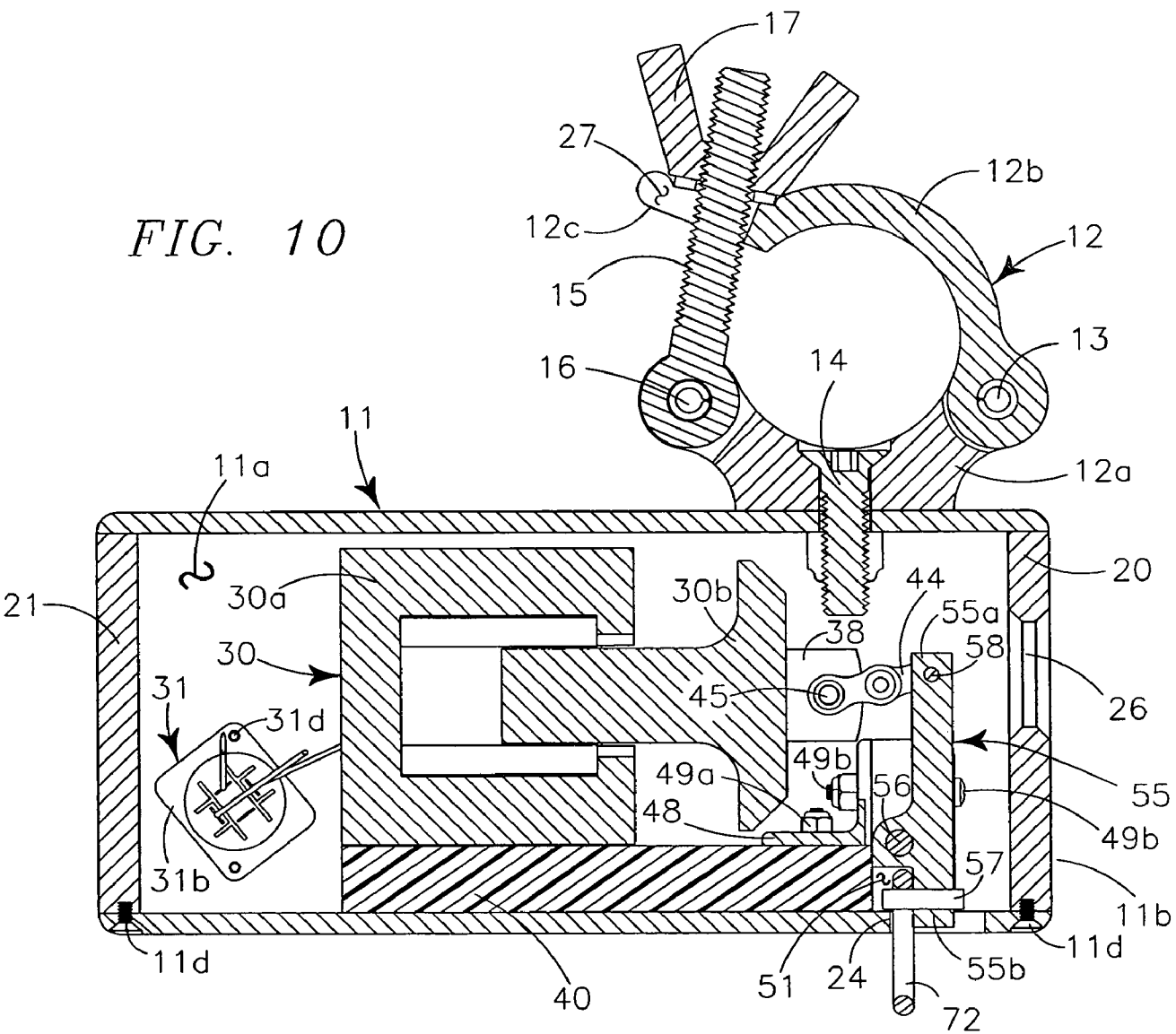
FIG. 10 is an enlarged cross-section view of the device of FIG. 3 taken along line 10-10 thereon in the direction indicated by the arrows thereon.

As seen in FIG. 9 pivoting lever arm 55, having upper end portion 55*a* and a lower end portion 55*b*, is pivotally carried in the lever slot 50 on a lever arm axle 56 (FIGS. 9, 10). The lever arm axle 56 extends transversely through the lever arm 55 spacedly adjacent the lower end portion 55*b* so that mechanical advantage is provided to lower end portion 55*b* relative to movement of upper end portion 55*a*. Laterally extending portions of lever arm axle. 56 are carried in similar opposed arm axle holes 52 defined in the lever blocks 46. In the preferred embodiment, the position of lever arm axle 56, through lever arm 55, provides a three-to-one mechanical advantage between opposing end portions 55*a*, 55*b* of lever arm 55. Ring support pin 57 is carried at lower end portion 55*b* of lever arm 55 to extend perpendicular to lever arm axle 56 rearwardly into and across ring chamber 51 at first forward end 40*a* of base 40.

Pulling solenoid 30 having body 30*a* and movable arm 30*b* is releasably fastened to the top surface of base 40 between the first and second edge portions 40*c*, 40*d* and adjacent the second end portion 40*b* by mounting brackets 42 and plural releasable fasteners 43, extending therebetween. Movable arm 30*b* extends forwardly from body 30*a* and is drawn rearwardly toward body 30*a* when electric current is supplied to a coil (not shown) within body 30*a*. Connection plates 38 carried on opposing lateral portions of arm 30*b* journal solenoid chain connecting bolt-nut combination 45 extending therebetween at forward end portions distal from body 30*a*. Chain links 44 interconnects solenoid chain connecting bolt-nut combination 45 and chain connecting pin 58 at upper end portion 55*a* of lever arm 55 so that movement of the solenoid arm 30*b* is communicated to upper end portion 55*a* of lever arm 55.

Figure 8:
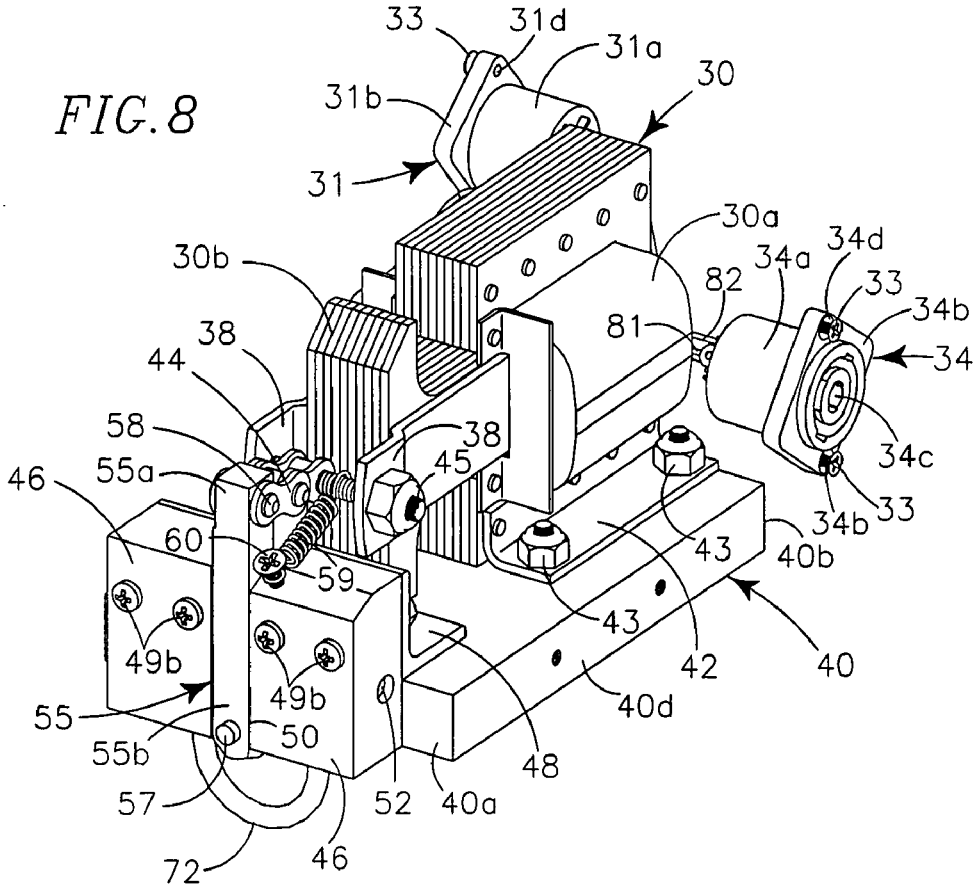
FIG. 8 is an isometric top, front and left side view of the mechanism of FIG. 7.

As shown in FIG. 8, spring 59 communicates between one lever block 46 and solenoid chain connecting bolt-nut combination 45. Fastening screw 60 positionally secures the forward end portion of the spring 59 to the one lever block 46 to bias arm 30*b* to a forwardly extended position. When in the forwardly extended position, solenoid arm 30*b* pivots the lever arm 55 into a position whereat ring support pin 57, carried at lower end portion 55*b* of lever arm 55, extends rearwardly into and across ring chamber 51 so that metal ring 72 may be positionally maintained in the ring chamber by support pin 57.

First and second wiring plug connectors 31, 34, preferably are Neutrik Model NL4MP distributed by Neutrik USA, Inc., of 195 Lehigh Ave., Lakewood, N.J. 08701-4527, each having generally cylindrical plug bodies 31*a*, 34*a*, defining medial plug receptacles 31*b*, 34*b* carries plural spaced electrical contacts and having fastening flanges 31*b*, 34*b* thereabout defining plural fastener holes 31*d*, 34*d*. First and second wiring plug connectors 31, 34 are releasably carried, in a recessed position, in holes 22, 23 defined in side portions of the body 11 and are positionally secured by releasable fasteners 33 engaged in holes 31*d*, 34*d* defined in flanges 31*b*, 34*b* and extending through body 11.

Figure 11:
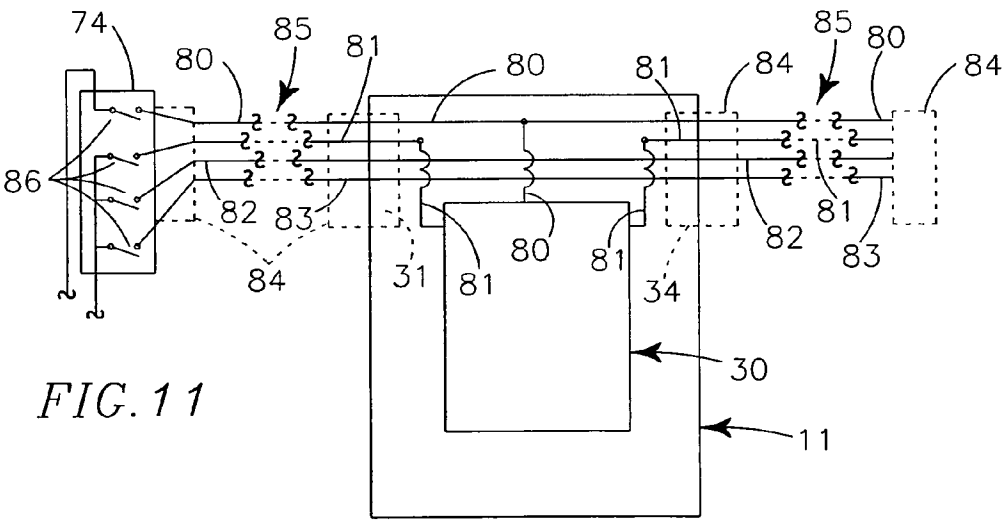
FIG. 11 is a diagram showing the circuitry of my Kabuki device with a cable jumper interconnecting the device to a controller.

As seen in FIG. 11 first and second wiring plug connectors 31, 34 are wired in series electrical communication with each other and with the solenoid 30 of the associated Kabuki. Common lead 80 interconnects with first wiring plug connector 31 with the solenoid 30 and with the second wiring plug connector 34 providing a common ground for the solenoid 30. Power lead 81 communicates in series with first wiring plug connector 31, solenoid 30 and second wiring plug connector 34. Upon actuation electric current is transmitted from switchable controller 74, through power cable 81 to first wiring plug connector 31, solenoid 30 and second wiring plug connector 34. The electric signal causes solenoid 30 to actuate, pulling solenoid arm 30*b* and upper end portion 55*a* of lever arm 55 toward solenoid body 30*a* which responsively pivots lower end portion 55*b* of lever arm 55 forwardly to release metal ring 72 from ring support pin 57 and allow the metal ring 72 to move from the ring chamber 51.

Figure 12:
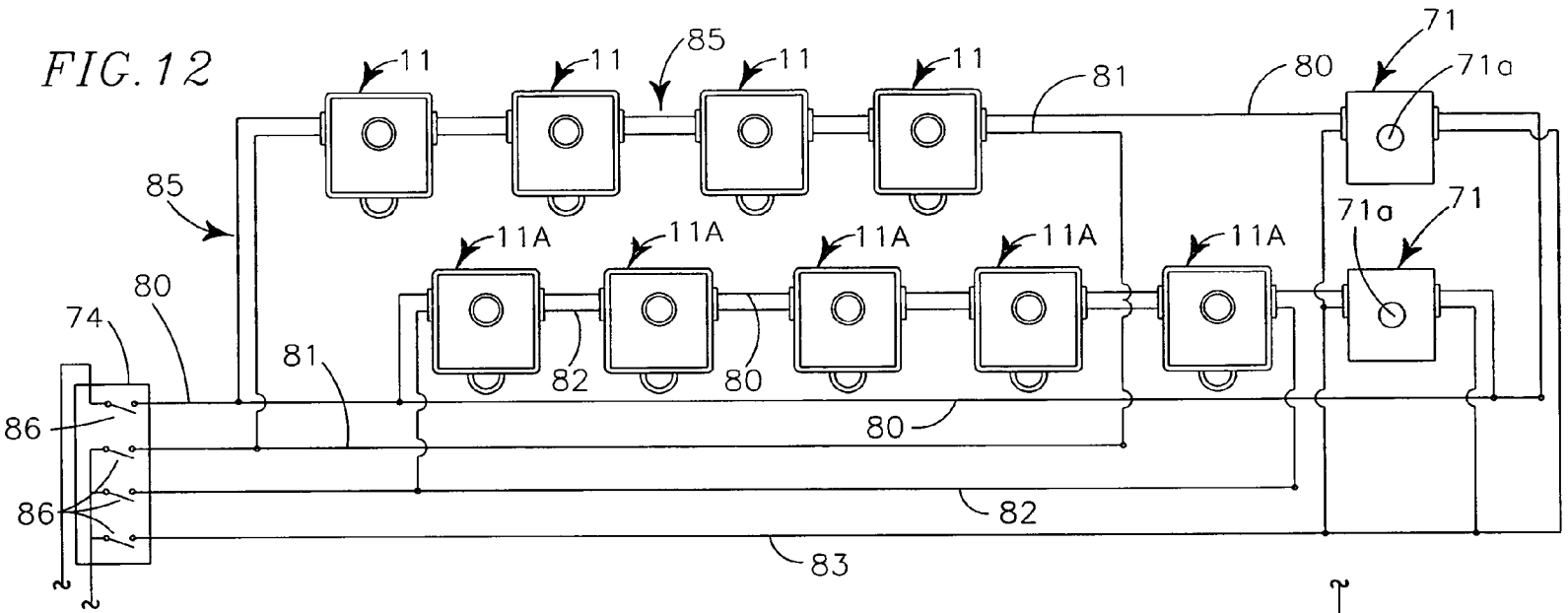
FIG. 12 is a diagram showing circuitry of plural series interconnected Kabuki devices test lights both interconnected in parallel with a controller and a power source.

As shown in FIG. 12, plural pass through power leads 82 may be used in a wiring harness for multiple Kabuki devices to create groups of Kabuki devices that act uniformally within the group but independently of other groups. FIG. 12 shows two such groups of Kabuki devices 11 and 11*a*. Pass through power lead 82 interconnects first wiring plug connector 31 and second wiring connector 34, but bypasses solenoid 30. Plural pass through power leads 82 may be used in a wiring harness to allow the creation of plural sub-groups also known as channels, of series interconnected Kabuki devices which can be independently actuated by passing current from controller 74 through the appropriate pass through lead 82.

Each Kabuki device is provided with a visible identifier (not shown), such as a unique number, color or letter identifying power lead 81 that communicates with the solenoid 30 for that particular Kabuki device 11, 11*a*. The visible indicator allows an operator to group Kabuki devices into channels that may be actuated at the same time in response to the same electrical signal.

Each jumper cable 83 has a plug connector 84, preferably the aforesaid Neutrik NL4FC, at each opposing end portion. Each plug connector 84 is generally cylindrical, carries plural electrical contacts (not shown) and is configured to operatively engage with receptacles 31*c*, 34*c* of first and second wiring plug connectors 31, 34 carried by the body 11. Each plug connector 84 has a known locking protrusion (not shown) that engages with a cooperating groove (not shown) defined in the first and second wiring plug connectors 31, 34 to prevent inadvertent disconnections and ensure that plug connectors 84 and first and second wiring plug connectors 31, 34 are properly aligned for operative engagement and interconnection. The alignment ensures the electrical connections are predictable using visual indicators (not shown) on the body 11.

As shown in FIG. 11, jumper cable 85 is used to operatively interconnect a first Kabuki device to the controller 74 by engaging one plug connector 84 of the cable jumper 83 to a mating receptacle (not shown) on the controller 74, and engaging the second plug connector 84 of the jumper cable 85 with one of the wiring plug connectors 31, 34 of the Kabuki device. Similar jumper cables 85 may be used to interconnect plural Kabuki devices in a series circuit with jumper cables 85 operatively engaging and extending between adjacent Kabuki devices (FIG. 12).

Figure 13:
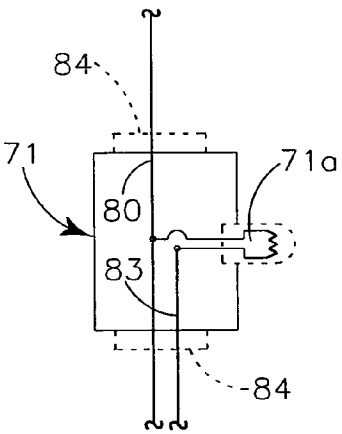
FIG. 13 is a diagram of the power indicator test light circuit.

Power indicator test light 71 (FIGS. 12 and 13) is used to test the continuity of a series circuit having plural interconnected Kabuki devices. The power indicator test light 71 may operatively engage with any wiring plug connectors 31, 34 but preferably interconnects with the last Kabuki device in a series circuit that is most distal from controller 74. Power indicator test light 71 has light bulb 71*a* that illuminates when electric current is supplied to it. Light bulb 71*a* is in electrical communication with the common ground lead 80 and power test lead 83 so that when electrical power is supplied through the power test lead, light bulb 71*a* will light if the common ground lead circuit 80 through a series connected Kabuki devices is completed. The illumination of light bulb 71*a* provides visual evidence of the circuit integrity without operating the solenoids 30 of the Kabuki device to release stage settings they may be supporting.

Having described the structure of my Kabuki stage setting release device, its operation may be understood.

At least one Kabuki device is releasably fastened to a supporting structure (not shown), such as a scaffolding rod that has not yet been raised into position. Hinged scaffold clamp 12 is opened by loosening wing nut 17 and pivoting clamp securing bolt 15 out of notch 27 defined in pivoting portion 12*b* of clamp 12. A portion of the scaffolding rod is positioned between pivoting portion 12*b* and base portion 12*a* of scaffold clamp 12, clamp securing bolt 15 is pivoted back into notch 27 and wing nut 17 is tightened to secure scaffold clamp 12 and the Kabuki device to the scaffolding. If more than one Kabuki device is to be used for the same stage setting drop, each Kabuki device being used should have the same visual indicator (not shown) and must have the same jumper cable 85 interconnection thereon so that every Kabuki device in the circuit will be identifiable and actuate in response to receipt of the same electric signal.

The stage setting, having one or more spaced metal rings 72 along an edge portion for support, is positioned adjacent to Kabuki devices. The operator inserts a finger through finger hole 26 defined in first end cover 20 and pushes upper end portion 55*a* of lever arm 55 rearwardly to overcome the biasing of spring 59. As upper end portion 55*a* of lever arm 55 moves rearwardly, lower end portion 55*b* of lever arm 55 pivots forwardly so that the ring support pin 57 is withdrawn rearwardly from the ring chamber 51. The adjacent metal ring 72 attached to the stage setting (not shown) is partially inserted into slot 24 defined in the bottom portion of body 11 and into ring chamber 51. The trapezoidal configuration of ring chamber 51 positionally centers metal ring 72 in ring chamber 51. The operator releases pressure on upper end portion 55*a* of lever arm 55 causing spring 59 to move the lower end portion 55*b* of lever arm 55 rearwardly so that ring support pin 57 extends into and across ring chamber 51 and through a medial portion of metal ring 72. The described process is repeated for each Kabuki device to be used in the stage setting drop group.

Jumper cables 85 having plug connector 84 at each opposing end are positioned between adjacent Kabuki devices. A protrusion (not shown) on each plug connector 84 is aligned with a groove (not shown) defined in each first and second wiring plug connector 31, 34 and plug connectors 84 are engaged with the wiring plug connectors 31, 34. Upon engagement, plug connectors 84 are rotated axially into a locking position that positionally maintains the interconnection of connectors 84 and 31, and connectors 84 and 34. The locking position establishes operative electrical communication between the electrical contacts carried by plug connectors 84 and first and second wiring connectors 31, 34 and establishes an operative series electrical circuit therebetween. The above described process is repeated for each Kabuki device in the series circuit. A similar jumper cable 85 is used to interconnect the first Kabuki device in the series circuit with controller 74 (FIG. 11).

Power indicator test light 71 may be interconnected with the first or second wiring plug connectors 31, 34 of the Kabuki device most distant from controller 74. Light bulb 71*a* of power indicator test light 71 will illuminate when an electrical signal is transmitted through the power test lead 83 which verifies the integrity of the electrical connections without actuating solenoids 30.

After the interconnection of jumper cables 85 to the Kabuki devices the scaffolding may be raised into operative position. Upon cue, switches 86 on the controller 74 are activated to transmit electric power through jumper cables 85 and to the interconnected Kabuki devices causing solenoids 30 to actuate and release the desired stage setting.

The foregoing description of my invention is necessarily of a detailed nature so that a specific embodiment of the best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

What I claim is:

1. a Kabuki device for releasably positionally maintaining a stage setting having at least one metal ring at an edge portion for support, comprising in combination:

An elongate box-like body having first and second opposed longer surfaces and defining a medial chamber with a slot in the first surface communicating with the medial chamber and means on the second surface to releasably fasten the body to a support structure;

a solenoid carried by the body within the medial chamber and operatively communicating through a switch with an external electric power source to move an arm of the solenoid responsively to an electric signal;

a lever arm pivotally carried by the body within the medial chamber and having a first end portion pivotally connected to the solenoid arm and a second end portion carrying a ring support pin for motion across the slot defined in the body;

biasing means maintaining the lever arm at a position whereat the ring support pin extends across the slot to positionally maintain the metal ring of the stage setting in the medial chamber, two wiring plug connectors carried on the body in electrical series communication with each other, with the solenoid and through a switch with the power source; and a finger hole defined in a third end surface of the body to allow access to the lever arm to overcome the biasing means to place the at least one metal ring of a stage setting in fastenable position in the body slot.

2. The Kabuki device of claim 1, wherein:

the lever arm pivots on an axle that provides mechanical advantage to the end of the lever arm carrying the ring support pin.

3. The Kabuki device of claim 1, wherein:

the wiring plug connectors each have a common ground lead communicating with the solenoid, a power supply lead communicating with the solenoid and at least one power test lead that does not communicate with the solenoid.

4. The Kabuki device of claim 1, wherein:

the body defines a ring chamber communicating with the slot defined in the body and configured to center a metal ring inserted therein through the slot defined in the body.

5. The Kabuki device of claim 1, wherein:

at least one wiring plug connector carried by the body is a Neutrik Model NL4MP.

6. The Kabuki device of claim 1, further comprising:

a jumper cable having opposed ends each carrying a plug connector for releasable electrical engagement with wiring plug connectors carried by two bodies.

7. A Kabuki device for releasably positionally maintaining a stage setting having at least one metal ring at an edge portion for support and releasing the stage setting in response to an electric current from a power source, the Kabuki device comprising in combination:

An elongate box-like body having an upper and lower surface and defining a medial chamber with a slot defined in the lower surface communicating with the medial chamber and means on the upper surface to releasably fasten the body to a support structure;

a solenoid carried by the body within the medial chamber operatively communicating through a switch with an external electric power source to move an arm of the solenoid responsively to the electric signal;

a lever arm pivotally carried by the body within the medial chamber and having a first end portion pivotally connected to the solenoid arm with a link and a second end portion carrying a ring support pin for motion across the slot defined in the body, the lever arm pivotally carried on an axle that provides mechanical advantage to the second end portion of the lever arm;

a ring chamber, defined in the body adjacent the second end portion of the lever arm and about the ring support pin, communicating with the slot defined in the body and configured to center therein the at least one metal ring inserted through the slot for positional maintenance on the ring support pin;

a spring biasing the lever arm to a position whereat the at least one metal ring attached to the stage setting is positionally maintained in the ring chamber by the ring support pin;

two similar wiring plug connectors carried by the body in electrical series interconnection with each other, the wiring plug connectors each having a common ground lead communicating with the solenoid, a powered lead communicating with the solenoid, a powered test lead and at least one powered through lead that does not communicate with the solenoid;

a finger hole defined in one end of the body spacedly adjacent the lever arm to allow access to the lever arm to manually overcome the spring biasing of the lever arm to allow placement of the at least one metal ring of the stage setting in fastenable position in the body slot.

8. A Kabuki system for releasably positioning and positionally maintaining a stage setting having a plurality of metal rings at an edge portion for support comprising in combination:

a plurality of Kabuki devices of claim 1 interconnected in at least one group having common ground leads connected in series with each other and a power source and power leads connected in series with each other and through a switch with a power source;

a power indicator test light interconnected in series between a common ground lead of a Kabuki device and through a switch to a pass through power lead so that the power indicator test light illuminates to show continuity of the common ground leads though the Kabuki devices when power is applied to the pass through lead without activating the solenoids of any of the series interconnected Kabuki devices.

9. The Kabuki system of claim 8 wherein plural groups of Kabuki devices having serially interconnected ground leads and serially interconnected power leads for all groups connected through switches in parallel with a power source and each serially interconnected group of Kabuki devices having a power indicator test light interconnected in series between the common ground lead of the Kabuki devices most distal from the power source in each series connected group and a pass through power lead indicating through a switch to the power source so that the power indicator light lead series interconnected group of Kabuki devices will illuminate power supplied through the pass through power lead to indicate continuity of the interconnection of jumper cables with each group of series interconnected Kabuki devices without activating the solenoids of any Kabuki devices.

* * * * *